United States Patent [19]

Sporenberg et al.

[11] 4,022,367

[45] May 10, 1977

[54] DEVICE FOR CONVEYING METAL SHEETS FOR AFFIXATION TO A WINDUP DRUM FOR WINDING THEREON

[75] Inventors: Willi Sporenberg, Hemer; Herbert Klockenhoff, Menden, both of Germany

[73] Assignee: Sundwiger Eisenhutte Maschinenfabrik Grah & Co., Germany

[22] Filed: Aug. 2, 1976

[21] Appl. No.: 710,721

[30] Foreign Application Priority Data

Feb. 7, 1976 Germany ..... 2604909

[52] U.S. Cl. ..... 226/91; 226/158; 242/78.3

[51] Int. Cl.[2] ..... B65H 19/28

[58] Field of Search ..... 226/91, 92, 158, 159, 226/162, 167; 242/78.3, 78.8

[56] References Cited

UNITED STATES PATENTS

| | | | |
|---|---|---|---|
| 3,137,451 | 6/1964 | Spanke | 226/162 X |
| 3,847,319 | 11/1974 | Brandon et al. | 226/91 X |

FOREIGN PATENTS OR APPLICATIONS

| | | | |
|---|---|---|---|
| 2,138,088 | 5/1973 | Germany | 226/91 |

*Primary Examiner*—Robert W. Saifer
*Attorney, Agent, or Firm*—McGlew and Tuttle

[57] ABSTRACT

A device for conveying the leading edges of metal strips, belts and sheets to a fixation point on a reel drum for winding thereon includes a carriage which is movable from a pickup station in which clamping means on the carriage engages with the belt at a spaced location from its leading edge through an affixation point on the winding drum at which the leading edge is engaged so that it may be wound on the drum. The carriage carries the clamping means and in addition it carries first and second limitation members which are engageable with the metal sheet between the clamping location and the forward edge. The limitation members are mounted on the carriage so that they may be moved outwardly and inwardly in respect to the clamping means and upwardly and downwardly in respect to the associated sheet so that they may be selectively and independently positioned so as to locate the edge of the sheet exactly in respect to a fixation point on the windup drum. The arrangement of the limitation members is such that they may be accommodated to the spacing necessary in accordance with the various thicknesses of metal sheets which are to be wound and in respect to the height of the fixation slot defined on the windup drum.

5 Claims, 2 Drawing Figures

DEVICE FOR CONVEYING METAL SHEETS FOR AFFIXATION TO A WINDUP DRUM FOR WINDING THEREON

BACKGROUND OF THE INVENTION

1. Field of the Invention

This invention relates in general to the construction of devices for positioning metal sheets into association with a windup drum for the winding of the sheets on the drum and in particular to a new and useful device for clamping the sheet and for positioning the outer edge of the sheet so that it may be precisely positioned into a fixation device such as a slot on the winding drum.

2. Description of the Prior Art

It is necessary when simultaneously coiling one or more belts or sheets or one belt split into several strips, to insert all of the belts or strips into the slot of a reel drum. Such an operation is particularly difficult when there is a large number of belts which must be simultaneously inserted into the receiving slot. The strips which are produced from the one belt by the cutting shears have portions which are arranged in different positions to one another due to the separation process and in addition they have cambers which vary from one belt to the other. In addition they are not easily accessible since they lie very close together.

One known device comprises an arrangement in which the strips are oriented on a fixed guideway and run against a stop so that their leading edges are thereby frontally aligned. Clamping means with gripping jaws then grasp the aligned metal belt portions in such a manner that the frontally aligned free leading edge lies over the clamping means at a predetermined distance from the edge. The clamping means comprise sliding elements which can be conveyed in the direction of the reel so that the portion of the freely overlying leading edge of the belt can be inserted into the slot of the reel drum by the clamping means. It has been shown that such a device does not operate in all cases without malfunction. It may therefore arise that the freely overlying leading edge is curved upwardly or downwardly and this curve lies at an elevation which is beyond the height of the fixation slot of the reel drum. Malfunctions in respect to insertion are caused by this which not only cause accidents but also involves a loss of time and an increased expense.

SUMMARY OF THE INVENTION

In accordance with the invention there is provided a device for conveying leading edges of metal belts so that they arrive at a fixation location of a windup drum in a correct orientation and position so that the edges may be easily inserted into a receiving slot of the fixation device. The invention includes a carriage or slide which is movable from a pickup point of the sheet or sheets which may for example be at the location immediately after the large sheet is fed into a cutting device for cutting it into individual longitudinally elongated strips. The carriage carries clamping means in the form of jaws which move together to clamp the metal sheet or sheets at a spaced location from the cutter. The carriage is movable from the pickup station to a position to present the leading edge of the picked up strips or sheet directly into the fixation device or slot of a winding drum which is thereafter rotated to wind up all of the strips on a common reel drum. In accordance with a feature of the invention limitation members are arranged above and below the sheet directly alongside or as part of the clamping means and they are not mounted in a manner such that they may individually move inwardly and outwardly in respect to the windup drum and upwardly and downwardly in respect to the sheet. In this manner the limitation members may be shifted to orient the leading edge or edges so that they may be aligned precisely in respect to the fixation slot and may be immediately brought into the slot during the movement of the carriage toward the windup drum.

Accordingly it is an object of the invention to provide a device for transferring metal sheets or strips from a pickup station into association with a fixation device on a windup drum which includes a clamping means for clamping the sheet and limitation members associated with the clamping means on a carriage which may be moved to the windup drum and which may be shifted upwardly and downwardly and inwardly and outwardly so that they may contact and position the leading edge of the picked up sheet or sheets so that the sheets may be oriented precisely in alignment with the fixation device of the reel drum.

A further object of the invention is to provide a device for conveying a metal sheet or sheets into association with a windup drum which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive manner in which there is illustrated a preferred embodiment of the invention.

GENERAL DESCRIPTION OF THE PREFERRED EMBODIMENT

Figure 1:
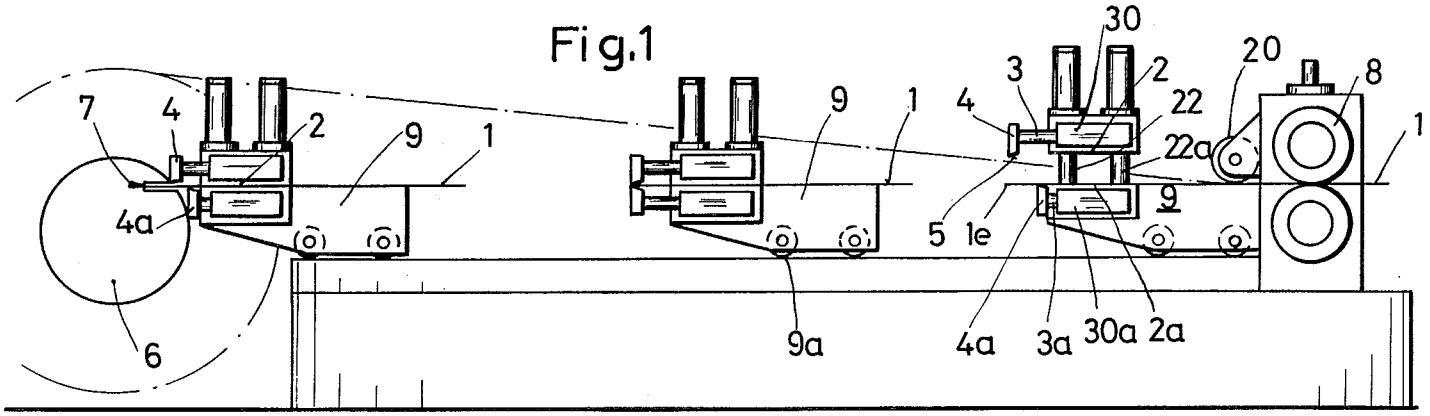
FIG. 1 is a schematic side elevational view of a device for transporting a plurality of metal strips into association with a reel drum constructed in accordance with the invention.

Referring to the drawings in particular the invention embodied therein comprises an apparatus for feeding metal belts or sheets or strips into association with a reel drum 6 having fixation means in the form of a slot 7.

In accordance with the invention, the metal belt or sheet 1 is fed into association with rotary cutting knives 8 which cut the sheet into individual elongated sheets 1'. Means are provided including roller 20 for feeding the sheets together after they are cut into association with clamping means including an upper movable jaw 2 and a lower jaw **2*a* which are moved together in order to clamp the sheet adjacent to but spaced from the outer edge 1*e*. The clamping jaws 2 and 2*a* extend over the complete width of all of the individual sheets 1' and they grasp the sheet from respective opposite sides. Preferably the leading edge of the sheets are aligned by means of a stop which can be swung out of the way and which is not shown. Clamping is effected inwardly from the edge 1*e* and by clamping means which are carried on a carriage 9. Carriage 9 includes wheels 9*a* to permit it to be rolled from the pickup position shown to the right hand of the drawing at the location of the cutters 8 to an intermediate position spaced in the direction toward the drum 6 and finally to a final position in which the carriage 9 is oriented directly adjacent the drum 6 as shown on the left hand side of FIG. 1**.

In accordance with a feature of the invention limitation elements 3 and 3*a* are mounted on respective opposite sides of the sheet 1 and they are associated with the clamping means on the carriage 9. The limitation members 3 and 3*a* comprise pistons which are slidable in cylinders 30 and 30*a* so as to be movable toward and away from the reel drum 6. In addition the cylinders 30 and 30*a* are carried on block members which ride up and downwardly on pistons 22 and 22*a* so that each cylinder 30 and 30*a* with its associated limitation element 3 and 3*a* may be moved selectively either toward or away from the associated sheet or strips 1′.

In accordance with a further feature of the invention the limitation elements are connected to a head portion 4 which extends completely across the path of the feed of the metal strips 1′ and they are aligned adjacent the outer edge 1*e* and may be moved relatively thereto to deflect the free edge of the individual sheets 1′ upwardly or downwardly. In addition when the carriage 9 arrives at the position in which the sheet ends engage into the fixation slot 7 upper member 3 is positioned outwardly to still engage the sheet which is positioned in the slot whereas the lower one is retracted so that it does not interfere with the closeup movement of the carriage 9 against the surface of the drum 6.

In accordance with another feature of the invention the head portion 4 of each limitation member is provided with an inclined surface 5 which inclines in a direction toward the sheet 1 proceeding toward the drum 6. The position of the limitation members 3 and 3*a* are controlled by admitting fluid pressure to the cylinders 30 and 30*a* which may for example be regulated in accordance with the position of the carriage 9 or controlled by a manual setting. Similarly the elevation of the cylinders 30 and 30*a* or the spacing thereof away from the associated sheet 1 may be controlled by regulating the fluid pressure in the support cylinders for these elements. The inclined surfaces 5 of the respective limitation elements 3 and 3*a* form a wedge-shaped forward running channel for the metal belt 1.

Figure 2:
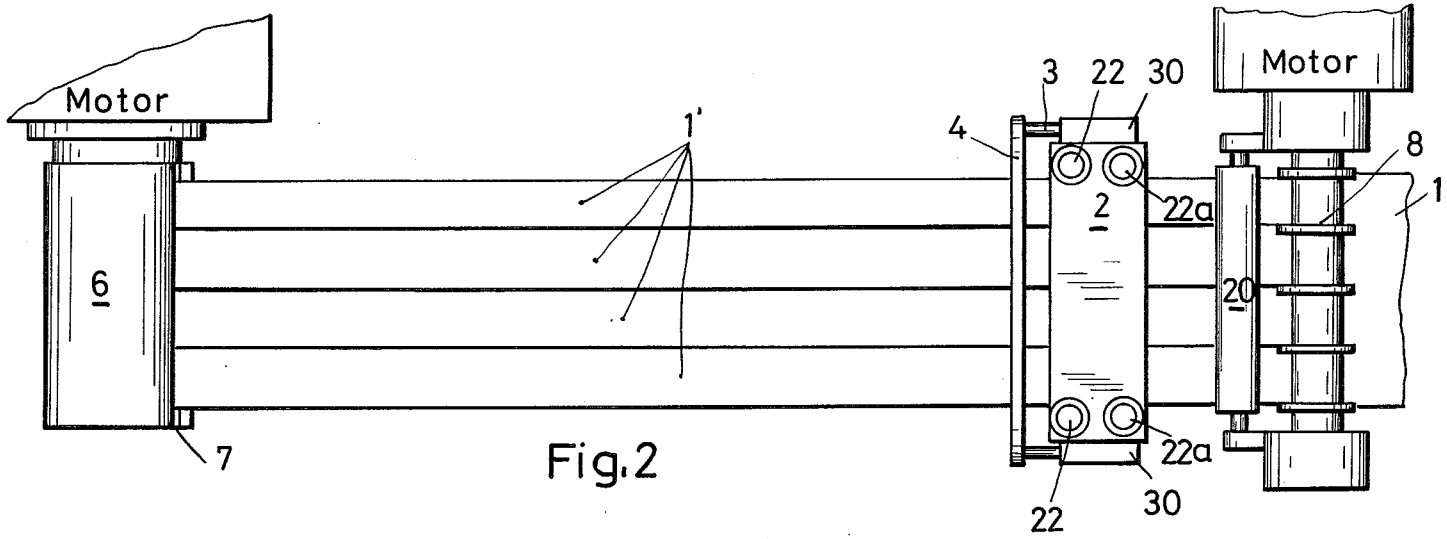
FIG. 2 is a partial top plan view of the device shown in FIG. 1.

The operation of the device is as follows:

After the sheet 1 or the individual strips 1′ are fed over the lower jaw 2*a* the upper jaw 2 is closed thereover to leave a marginal edge extending inwardly from the bitter end 1*e* through the clamping means. This position is shown in the intermediate position indicated in FIG. 1. In this position the limitation elements are moved to engage downwardly over the edge 1*e* or as close to the edge as possible. Upon the further movement of the carriage from the intermediate position shown to the end position adjacent the reel drum 6 it is desirable that the upper limitation element 3 be moved further toward the drum than the lower one and in fact the lower one should be retracted somewhat. This final position then makes it easier to feed the bitter end 1*e* into the fixation slot 7 and it insures that the end 1*e* will not be misaligned with the slot so that it feeds over the surface of the reel drum rather than into the slot. The spacing of the edge 1*e* from the clamping means may for example be a few mm and the total length of the strips which are fed may for example be about 100 mm. In the intermediate position the bitter end 1*e* may be held in a correctly oriented position by the two limitation means 3 and 3*a* and these may also be manipulated so as to permit the easy complete insertion of this end into the fixation slot 7 of the reel drum 6. In the end position shown in FIG. 1 the lower head 4*a* is located substantially at the surface of the reel drum 6. After the end is positioned in the fixation slot 7 the sliding carriage 9 moves back into its starting position which is shown in FIG. 2 and at the right hand side of FIG. 1. The limitation elements 3 and 3*a* can be adjusted in height to the plane of the metal belt independently of the clamping means so that it is possible to adjust the device each time to the thickness of the belt and the height of the slots 7 of the reel drum 6. A particular advantage of the device is that a plurality of strips can be inserted safely into the slot 7 of the reel drum 6 by a simple construction.

The limitation elements 3 and 3*a* are movable with the clamping means and they have no transport function themselves but they are mobile relatively in the direction of the clamping means on reaching the slot of the reel so that even the leading edge with an irregular surface may be inserted safely into the slot 7 of the reel drum 6. The limitation elements 3 and 3*a* do not themselves work as clamping means and they are conveyed into association with the reel drum 6 in such a way that they stop when striking against an obstruction such as the surface of the reel drum. The clamping means including the jaws 2 and 2*a* are moved further in the direction of the reel drum. This relative compliance of the limitation elements to the clamping means can be achieved by a spring or similar medium. The relative mobility of the limitation elements and conveying is preferably achieved by a cylinder piston mechanism. It is advantageous if an independent cylinder piston mechanism is provided for each limitation element. This cylinder piston mechanism has the advantage that the force to be overcome on striking against an obstruction can be easily adjusted to the desired value.

The provision of a head on the front ends of the limitation 3 and 3*a* with the inclined surfaces converging forward into engagement with the metal sheet provides a wedge-like interengagement with the sheet. Such a wedge-shaped channel has the advantage that the leading edge of the metal sheet may be inserted into the slot of the reel exactly in the center thereof and in addition the degree of friction is limited due to the inclined surface as the friction is substantially exerted only by the foremost part of the head 4 and 4*a*.

The limitation elements 3 and 3*a* are spaced from one another at their narrowest point as a practical measure. This space between them constitutes at least double the thickness of the belt 1 and less than half the height of the slot 7 of the reel drum 6. A safer insertion into the slot is guaranteed taking into consideration the inaccuracies arising in operation and the degree of friction at the inclined surface is in contrast not too high. The individual limitation elements preferably extend on the respective side of the sheet over the width of the whole sheet or the individual strips. The limitation elements 3 and 3*a* are advantageously a part of the clamping means and move together in the direction of the freely overlying leading edge when the clamping means moves with the carriage 9.

The inventive arrangement is particularly advantageous with strips having a width of less than 60 mm and or a thickness of less than 0.5 mm. It is with these narrow strips in particular that malfunctioning occurs in the prior art. It must be considered that the height of the slot of the reel amounts to from 10 to 20 mm depending on the position of the slot. The likelihood of malfunctioning may be relatively high with the plurality of strips. If it is considered further that the freely overlying leading edge of the belt may have a length of about 50 to 200 mm and that the bulk can have 20 to 50 strips 1' then it is evident that safer insertion is achieved by the simple means of the invention. The mobility or compliance of the limitation elements is particularly significant as this solution facilitates a safer insertion of the ends into the fixation slot and without damages being caused to any other parts of the device by impact.

While a specific embodiment of the invention has been shown and described in detail to illustrate the application of the principles of the invention, it will be understood that the invention may be embodied otherwise without departing from such principles.

What is claimed is:

1. A device for conveying the leading edges of metal strips and sheets to a fixation point on a reel drum for winding of the metal on the drum, comprising a carriage movable in directions toward and away from the drum, clamping means on said carriage for clamping the sheet adjacent to but spaced from its leading edge for moving it into association with the drum, and sheet end positioning means on said carriage engageable with the leading edge of the sheet outwardly of said clamping means for positioning the leading edge into alignment with the fixation point on the drum and including first and second limitation members engageable with respective opposite sides of said sheet and mounting means on said carriage mounting said limitation members for separate independent movement toward and away from said clamping means and toward and away from the respective sides of said sheet whereby to permit engagement of said sheet and movement of the edge thereof to align it with the fixation point on the reel drum.

2. The device according to claim 1, wherein said mounting means comprises a fluid pressure cylinder, said limitation member comprising a piston slidable in said cylinder.

3. A device according to claim 2, including fluid pressure means mounting said cylinder for up and down movement towards and away from the associated metal sheet.

4. A device according to claim 1, wherein said limitation members comprise a piston having a head portion extending across said sheets, said head portion having ends which are adapted to strike against the end of the reel drum and be moved backwardly thereby and have lower surfaces engageable with the sheets which converge in a direction toward the drum.

5. A device according to claim 1, wherein said first and second limitation members are spaced apart by an amount which comprises at least double the thickness of said metal sheets and by less than half of the height of the fixation point.

* * * * *